US010576337B2

(12) United States Patent
Soracco et al.

(10) Patent No.: US 10,576,337 B2
(45) **Date of Patent: *Mar. 3, 2020**

(54) GOLF CLUB HAVING MOVABLE WEIGHT AND COVER

(71) Applicant: Acushnet Company, Fairhaven, MA (US)

(72) Inventors: Peter L. Soracco, Carlsbad, CA (US); Sang Yi, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/233,722

(22) Filed: Dec. 27, 2018

(65) Prior Publication Data

US 2019/0192928 A1 Jun. 27, 2019

Related U.S. Application Data

(63) Continuation-in-part of application No. 15/853,259, filed on Dec. 22, 2017, now Pat. No. 10,183,203.

(51) Int. Cl.

| | |
|---|---|
| ***A63B 53/06*** | (2015.01) |
| ***A63B 53/04*** | (2015.01) |
| ***A63B 60/04*** | (2015.01) |
| ***A63B 60/52*** | (2015.01) |
| *A63B 71/06* | (2006.01) |
| *A63B 60/02* | (2015.01) |

(52) U.S. Cl.

CPC ..... *A63B 53/0466* (2013.01); *A63B 60/04* (2015.10); *A63B 60/52* (2015.10); *A63B 60/02* (2015.10); *A63B 2053/045* (2013.01); *A63B 2053/0433* (2013.01); *A63B 2053/0491* (2013.01); *A63B 2053/0495* (2013.01); *A63B 2071/0625* (2013.01); *A63B 2071/0655* (2013.01); *A63B 2209/00* (2013.01)

(58) Field of Classification Search

USPC ..... 473/324–350

See application file for complete search history.

(56) References Cited

U.S. PATENT DOCUMENTS

| | | | | |
|---|---|---|---|---|
| 2,155,830 A | | 4/1939 | Howard | |
| 4,895,371 A | * | 1/1990 | Bushner | A63B 60/02 473/336 |
| 5,720,674 A | | 2/1998 | Galy | |
| 5,769,737 A | * | 6/1998 | Holladay | A63B 53/06 473/336 |

(Continued)

FOREIGN PATENT DOCUMENTS

| | | | |
|---|---|---|---|
| JP | 06238022 A | | 8/1994 |
| JP | 06238022 A | * | 8/1994 |

(Continued)

*Primary Examiner* — Alvin A Hunter

(74) *Attorney, Agent, or Firm* — Randy K. Chang

(57) ABSTRACT

A golf club head is presented comprising a sole including a weight member that is slidable in an elongate weight mount including a rail with or without a cover. The weight member is preferably constructed so that it is assembled in the weight mount and is locked by configuring the weight member to pinch the rail. The cover member can cover the weight, the weight mount, or even just an opening on the sole of the golf club head.

17 Claims, 12 Drawing Sheets

(56) References Cited

U.S. PATENT DOCUMENTS 6,015,354 A * 1/2000 Ahn ..... A63B 53/04 473/256
6,277,032 B1 * 8/2001 Smith ..... A63B 53/04 473/336
7,147,573 B2 * 12/2006 DiMarco ..... A63B 53/0466 473/324
7,166,041 B2 * 1/2007 Evans ..... A63B 53/0466 473/334
7,186,190 B1 3/2007 Beach et al.
7,201,669 B2 * 4/2007 Stites ..... A63B 53/047 473/337
7,452,286 B2 * 11/2008 Lin ..... A63B 53/0466 473/334
7,520,820 B2 * 4/2009 DiMarco ..... A63B 53/0466 473/334
7,611,424 B2 * 11/2009 Nagai ..... A63B 53/0466 473/334
7,717,803 B2 5/2010 DiMarco
7,775,905 B2 * 8/2010 Beach ..... A63B 53/0466 473/334
7,854,667 B2 * 12/2010 Gillig ..... A63B 53/0466 473/334
8,016,694 B2 * 9/2011 Llewellyn ..... A63B 53/0466 473/334
8,096,039 B2 * 1/2012 Soracco ..... A63B 53/0487 29/525.01
8,192,303 B2 * 6/2012 Ban ..... A63B 53/0466 473/335
8,202,175 B2 * 6/2012 Ban ..... A63B 53/0466 473/338
8,262,495 B2 * 9/2012 Stites ..... A63B 53/047 473/226
8,435,136 B2 5/2013 Stites et al.
8,690,706 B2 4/2014 Stites et al.
8,696,491 B1 * 4/2014 Myers ..... A63B 53/0466 473/334
8,870,678 B2 10/2014 Beach et al.
8,894,506 B1 * 11/2014 Myers ..... A63B 53/0466 473/334
9,174,096 B2 11/2015 Sargent et al.
9,180,349 B1 * 11/2015 Seluga ..... A63B 53/04
9,199,145 B1 12/2015 Myers
9,211,447 B2 12/2015 Harbert et al.
9,211,453 B1 12/2015 Foster et al.
9,216,332 B1 * 12/2015 Ehlers ..... A63B 53/06
9,238,162 B2 1/2016 Breier et al.
9,238,168 B2 1/2016 Kloster et al.
9,289,660 B1 * 3/2016 Myers ..... A63B 53/06
9,364,728 B1 * 6/2016 Myers ..... A63B 53/06
9,381,410 B2 * 7/2016 Golden ..... A63B 53/0466
9,387,376 B1 * 7/2016 Hall ..... A63B 53/06
9,433,836 B2 * 9/2016 Breier ..... A63B 53/0466
9,597,561 B1 * 3/2017 Seluga ..... A63B 53/06
9,623,294 B1 * 4/2017 Kingston ..... A63B 53/0466
9,630,069 B2 4/2017 Foster et al.
9,636,553 B1 * 5/2017 Myers ..... A63B 53/0466
9,675,856 B1 * 6/2017 Gibbs ..... A63B 53/0466
9,682,296 B1 * 6/2017 Myers ..... A63B 53/0466
9,682,298 B1 * 6/2017 Kingston ..... A63B 53/0466
9,694,256 B2 * 7/2017 Myers ..... A63B 53/0466
9,694,261 B2 * 7/2017 Nunez ..... A63B 60/52
9,700,764 B2 * 7/2017 Carter ..... A63B 53/0466
9,707,459 B1 * 7/2017 Myers ..... A63B 53/0466
9,724,577 B1 * 8/2017 Kingston ..... A63B 53/06
9,731,175 B1 * 8/2017 Myers ..... A63B 53/0466
9,731,178 B1 * 8/2017 Myers ..... A63B 53/06
9,914,027 B1 * 3/2018 Harbert ..... A63B 53/0466
9,914,028 B1 * 3/2018 Cleghorn ..... A63B 53/0466
10,022,602 B2 * 7/2018 Kingston ..... A63B 53/06
10,029,161 B2 * 7/2018 Knutson ..... A63B 53/0466
10,137,342 B2 * 11/2018 Hebreo ..... A63B 53/06
10,183,203 B1 * 1/2019 Yi ..... A63B 53/0466
2006/0122004 A1 6/2006 Chen et al.
2008/0020861 A1 1/2008 Adams et al.
2008/0261715 A1 10/2008 Carter
2010/0075773 A1 3/2010 Casati, Jr.
2016/0279490 A1 9/2016 Onuki

FOREIGN PATENT DOCUMENTS

JP 09028844 A * 2/1997
JP 09028844 A 2/1997
JP 2760723 6/1998
JP 2005296582 A * 10/2005
JP 2005296582 A 10/2005
JP 2005323978 A * 11/2005
JP 2005323978 A 11/2005
JP 2006320493 A * 11/2006
JP 2006320493 A 11/2006
JP 2008194454 A 8/2008
JP 2008194454 A * 8/2008 ..... A63B 53/0466
JP 2010148702 A 7/2010
JP 2010148702 A * 7/2010 ..... A63B 53/0466
JP 2010252964 A 11/2010
JP 2010252964 A * 11/2010
JP 2011010722 A 1/2011
JP 2011010722 A * 1/2011
WO WO 2007044220 A1 4/2007
WO WO-2007044220 A1 * 4/2007 ..... A63B 53/06

* cited by examiner

GOLF CLUB HAVING MOVABLE WEIGHT AND COVER

CROSS-REFERENCE TO RELATED APPLICATIONS

The present application is a Continuation-In-Part of U.S. patent application Ser. No. 15/853,259, filed on Dec. 22, 2017. The disclosure of which is incorporated by reference in its entirety.

FIELD OF THE INVENTION

The invention relates to golf clubs, and more particularly, to golf club heads having a movable weight and cosmetically appealing weight and or port covers on the sole.

BACKGROUND OF THE INVENTION

The trend of lengthening golf courses to increase their difficulty has resulted in a high percentage of amateur golfers constantly searching for ways to achieve more distance from their golf shots. The golf industry has responded by providing golf clubs specifically designed with distance and accuracy in mind. The size of wood-type golf club heads has generally been increased while multi-material construction and reduced wall thicknesses have been included to provide more mass available for selective placement through the head. The discretionary mass placement has allowed the club to possess a higher moment of inertia (MOI), which translates to a greater ability to resist twisting during off-center ball impacts and less of a distance penalty for those off-center ball impacts.

Various methods are used to selectively locate mass throughout golf club heads, including thickening portions of the body casting itself or strategically adding separate weight element during the manufacture of the club head. An example, shown in U.S. Pat. No. 7,186,190, discloses a golf club head comprising a number of moveable weights attached to the body of the club head. The club head includes a number of threaded ports into which the moveable weights are screwed. Though the mass characteristics of the golf club may be manipulated by rearranging the moveable weights, the cylindrical shape of the weights and the receiving features within the golf club body necessarily moves a significant portion of the mass toward the center of the club head, which may not maximize the peripheral weight of the club head or the MOI.

Alternative approaches for selectively locating mass in a club head utilize composite multi-material structures. These composite structures utilize two, three, or more materials that have different physical properties including different densities. An example of this type of composite club head is shown in U.S. Pat. No. 5,720,674. The club head comprises an arcuate portion of high-density material bonded to a recess in the back-skirt. Because composite materials like those found in the club head must be bonded together, for example by welding, swaging, or using bonding agents such as epoxy, they may be subject to delamination or corrosion over time. This component delamination or corrosion results in decreased performance in the golf club head and can lead to club head failure.

Further alternatives include a weight that is positioned within a channel formed in a golf club head. Generally, the weight must be inserted into an enlarged portion of the channel and then a plug inserted so that the weight is not ejected from the channel during use.

Though many methods of optimizing the mass properties of golf club heads exist, there remains a need in the art for a golf club head comprising at least a removable weight having secure attachment and a low-profile so that the weight does not protrude into the center of the club head and negatively affect the location of the center of gravity.

SUMMARY OF THE INVENTION

The present invention is directed to a golf club head having a portion comprising at least one movable weight member. The movable weight member is preferably structured so that it can be assembled in a weight mount.

In an embodiment, a golf club head includes a hosel, a ball striking face, a sole, a crown a skirt, a weight mount, and a weight member. The sole extends aftward from a lower edge of the face. The crown extends aftward from an upper edge of the face. The skirt extending between the sole and the crown. The weight mount is disposed on at least one of the sole, the crown and the skirt and includes parallel side walls and an elongate rail. The side walls extend from an outer surface of the golf club head and toward an interior of the golf club head and form a recessed channel. The rail protrudes into the interior of the recessed channel, defines lateral undercuts, and extends longitudinally through the recessed channel. The weight member includes a first weight component, a second weight component, and an actuator. Each of the first and second weight components defines an outer end and an inner end, and the first and second weight components combine to define a slot and a bore that intersects the slot. The bore extends through the outer ends of the first and second weight components. The inner ends of the first and second weight components are disposed in the lateral undercuts of the rail. The actuator includes a threaded fastener and a threaded nut. The threaded nut is disposed in the slot, and the threaded fastener is disposed in the bore and is threaded into a threaded bore included in the threaded nut. The threaded fastener includes a tapered surface that abuts a tapered surface on each of the first and second weight components, and the tapered surfaces are angled so that the surfaces are tapered toward the center of the weight member as the tapered surfaces extend deeper into the weight mount so that the first and second weight components are forced laterally outward as the threaded fastener is advanced into the threaded nut. A portion of the side walls of the weight mount is cylindrical and a portion of the outer surface of the weight member is cylindrical. The weight member has an unlocked configuration and a locked configuration. In the unlocked configuration the threaded fastener is in a first position and in the locked configuration the threaded fastener is in a second position threaded further into the threaded nut than in the first position and the tapered surface of the threaded fastener forcibly abuts the tapered surfaces of the first and second weight components so that the inner ends of the first and second weight components forcibly pinch the rail.

In another embodiment, a golf club head comprises a hosel, a ball striking face, a sole, a crown, a skirt, a weight mount, and a weight member. The sole extends aftward from a lower edge of the face. The crown extends aftward from an upper edge of the face. The skirt extends between the sole and the crown. The weight mount is disposed on at least one of the sole, the crown and the skirt, and the weight mount includes parallel side walls and an elongate rail. The side walls extend from an outer surface of the golf club head and toward an interior of the golf club head and form a recessed channel. The rail protrudes into the interior of the recessed channel, defines lateral undercuts, and extends longitudinally through the recessed channel. The weight member includes a first weight component, a second weight component, and an actuator. Each of the first and second weight components defines an outer end and an inner end, and the first and second weight components combine to define a tapered bore. The tapered bore is threaded and extends through the outer ends of the first and second weight components, and the inner ends of the first and second weight components are disposed in the lateral undercuts of the rail. The actuator is a threaded fastener and a threaded side wall of the threaded fastener is tapered, and the threaded fastener is threaded into the tapered bore. The taper of the threaded fastener and the tapered bore are angled so that the surfaces are tapered toward the center of the weight member as the tapered surfaces extend deeper into the weight mount so that the first and second weight components are forced laterally outward as the threaded fastener is advanced into the tapered bore. A portion of the side walls of the weight mount is cylindrical and a portion of the outer surface of the weight member is cylindrical. The weight member has an unlocked configuration and a locked configuration, in the unlocked configuration the threaded fastener is in a first position and in the locked configuration the threaded fastener is in a second position threaded further into the tapered bore than in the first position and the threaded fastener forcibly abuts the tapered bore of the first and second weight components so that the inner ends of the first and second weight components forcibly pinch the rail.

In a still further embodiment, a golf club head comprises a hosel, a ball striking face, a sole, a crown, a skirt, a weight mount, and a weight member. The sole extends aftward from a lower edge of the face. The crown extends aftward from an upper edge of the face. The skirt extends between the sole and the crown. The weight mount disposed on at least one of the sole, the crown and the skirt. The weight mount includes parallel side walls and an elongate rail. The side walls extend from an outer surface of the golf club head and toward an interior of the golf club head and form a recessed channel and the side walls define lateral undercuts. The rail protrudes into the interior of the recessed channel and extends longitudinally through the recessed channel. The weight member includes a first weight component, a second weight component, and an actuator. Each of the first and second weight components defines an outer end and an inner end, and the first and second weight components combine to define a slot and a bore that intersects the slot. The bore extends through the outer ends of the first and second weight components. Middle portions of the first and second weight components are disposed in the lateral undercuts of the side walls of the weight mount. The actuator includes a threaded fastener and a threaded nut. The threaded nut is disposed in the slot, and the threaded fastener is disposed in the bore and is threaded into a threaded bore included in the threaded nut. The threaded fastener includes a tapered surface that abuts a tapered surface on each of the first and second weight components. The tapered surfaces are angled so that the surfaces are tapered toward the center of the weight member as the tapered surfaces extend deeper into the weight mount so that the first and second weight components are forced laterally outward as the threaded fastener is advanced into the weight member. A portion of the side walls of the weight mount is cylindrical and a portion of the outer surface of the weight member is cylindrical. The weight member has an unlocked configuration and a locked configuration, in the unlocked configuration the threaded fastener is in a first position and in the locked configuration the threaded fastener is in a second position threaded further into the threaded nut than in the first position and the tapered surface of the threaded fastener forcibly abuts the tapered surfaces of the first and second weight components so that the inner ends of the first and second weight components forcibly pinch the rail.

In another embodiment of the present invention, the golf club head further comprises a weight cover on the sole portion of the golf club head covering the weight member.

In another embodiment of the present invention, the golf club head further comprises a port cover on the sole portion of the golf club head covering an opening on the sole.

DETAILED DESCRIPTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The golf club head of the present invention is preferably hollow, such as a metal wood type golf club head, but may include any club head type, such as iron-type club heads. The golf club head generally includes a hosel, a hitting face, a crown, a sole, and a skirt that combine to define a hollow interior cavity.

Figure 1:
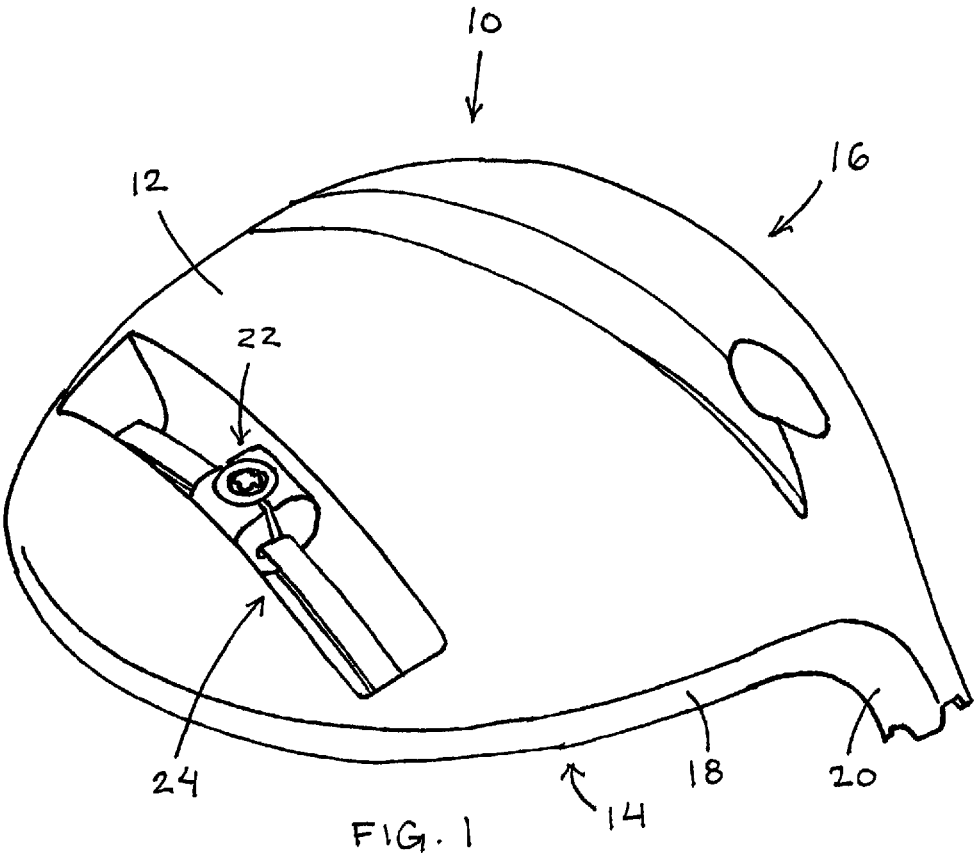
FIG. 1 is a perspective view of the sole of a golf club head including a movable weight.

An exemplary golf club head is shown in FIG. 1. Golf club head 10 generally has a hollow, metalwood-type construction and includes a sole 12, a crown 14, a hitting face 16, a skirt 18, a hosel 20, and a weight member 22. Sole 12 generally provides the lower surface of golf club head 10 when the club head is placed in an address position. Sole 12 includes a weight mount 24, which is configured to couple the weight member 22 to the sole 12.

In the present embodiment, weight mount 24 is an elongate recessed channel portion of the golf club head that forms a channel. In particular, side walls 31 of the weight mount 24 extend from the outer surface of the golf club head toward an interior of the golf club head 10. The side walls 31 are generally parallel and the innermost portions of the side walls 31 are generally curved toward and are coupled at the deepest portion of the channel formed by weight mount 24. As shown, the weight mount 24 is disposed on the sole 12, but it should be appreciated that the weight mount of any of the embodiments described herein may be located on any portion of the golf club head including the sole, crown, skirt, hosel, and/or face. The weight mount 24 may be generally linear when viewed from a bottom view of the golf club head, and the weight mount 24 defines an inner surface that is exposed to the exterior of the golf club head. In the present embodiment, a portion of the side wall 31 of the weight mount 24 is cylindrical.

Figure 2:
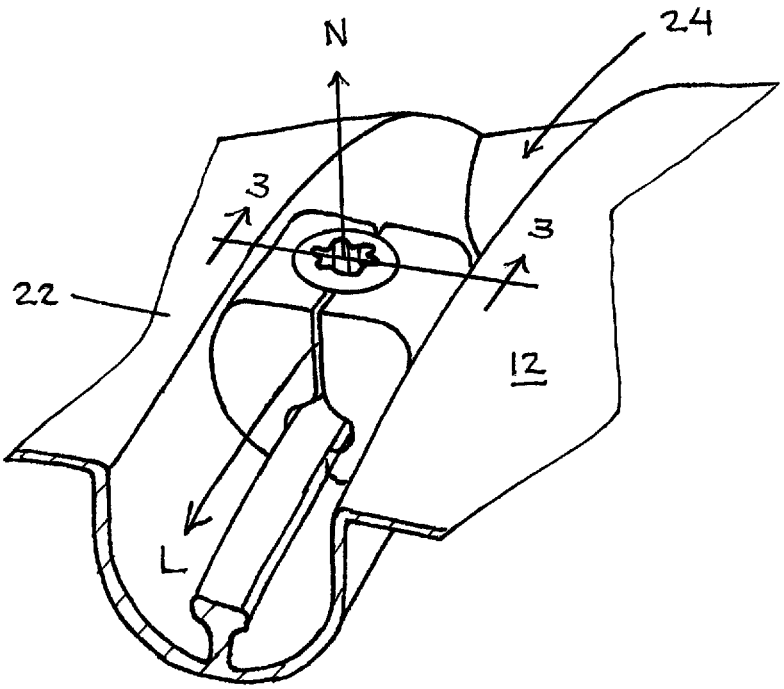
FIG. 2 is a perspective view of a portion of a golf club head of the present invention including a movable weight member.
Figure 3:
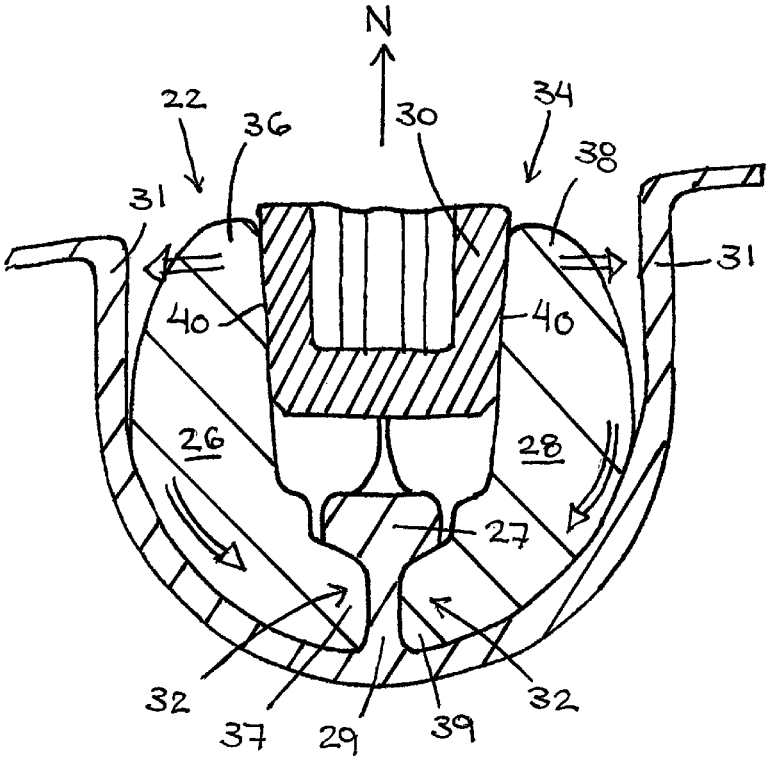
FIG. 3 is a cross-sectional view of a portion of the golf club head and movable weight member of FIG. 2, corresponding to line 3-3.

Weight mount 24 also includes a protruding rail 25 that is disposed inside the interior of the elongate recess in the innermost portion of weight mount 24 and the rail 25 generally extends longitudinally through the channel parallel to the side walls 31. In the present embodiment, the rail 25 has undercut side walls so that it has a cross-sectional shape that is generally wider at a free end 27 of the rail 25 than at a base 29 of the rail 25, and in particular has a cross-sectional shape that is generally "T"-shaped so that the rail includes stepped undercuts wherein the width changes drastically between the free end 27 and an intermediate portion of the rail. In the present example, the intermediate portion has an intermediate portion having a constant width between the free end 27 and the base 29. As an alternative, the cross-sectional shape may be triangular and oriented so that it also forms undercut side walls of the rail. As will be described in greater detail below, the undercut side walls of the rail 25 interact with the weight member 22 to restrict relative motion between the weight member and the weight mount in directions longitudinally along the weight mount and in a direction generally normal to the weight mount so that the weight member is retained within the weight mount, as shown by the normal ("N") and longitudinal ("L") axes illustrated in FIG. 2.

Generally, when it is assembled in the weight mount, the weight member may be configured to be unlocked or locked. In the unlocked configuration, the assembled weight member is movable along the elongate weight mount along the longitudinal axis L, but is restricted from being removed from the weight mount. In the locked configuration, the weight member interacts with the rail of the weight mount to restrict longitudinal movement of the weight member relative to the weight mount. Additionally, interaction between the weight member and the undercuts of the rail restrict relative movement between the weight member and the weight mount in a direction normal to the weight mount.

The weight member 22 has a multi-piece construction and each of the pieces is sized and shaped to allow the weight member 22 to be assembled within the weight mount 24. Generally, the weight member 22 includes a first weight component 26, a second weight component 28, and an actuator 30. Each of the first weight component 26 and second weight component 28 includes an outer surface that is at least partially cylindrical that complements the cylindrical side wall 31 of the weight mount 24.

The actuator 30 is coupled to the first weight component 26 and the second weight component 28 so that it spreads the outer ends of the weight components 26, 28 away from each other. When the outer ends are spread away from each other, the interaction between the weight outer surfaces of the components and the inner surfaces of the weight mount forces the weight components 26, 28 to rotate and slide along the side wall 31 of the weight mount 24. As a result, the inner ends of the weight components 26, 28 move toward each other and toward rail 25. As the inner ends of the weight components 26, 28 move toward each other, the rail 25 is pinched between them, thereby locking the weight member 22 in place longitudinally within weight mount 24.

The weight member 22 is constructed so that actuator 30 includes a tapered portion, such as tapered side wall 40 that abuts tapered side walls of the weight components 26, 28. Actuator 30 coupled to the weight components 26, 28 adjacent to their outer ends 36, 38, and actuator 30 is movable in a direction of the normal axis N relative to the weight components 26, 28 and weight mount 24. As actuator 30 is moved toward the inner ends 37, 39 of the weight components 26, 28, interaction between the tapered side walls forces the outer ends 36, 38 laterally away from each other and toward the side wall 31 of weight mount 24.

In an embodiment, the interface between the weight components 26, 28 includes a bore 34 that is at least partially threaded. At least a portion of the side wall of actuator 30 is threaded so that actuator 30 is threaded into bore 34. The threaded portion may also be tapered, such as tapered threads used in pipe fitting, or it may be formed as traditional parallel threads and another portion of the actuator may include a tapered side wall.

In the current embodiment, rail 25 includes a cross-section that forms lateral undercuts 32 and the inner ends of the weight components extend into the undercuts. Preferably, the inner ends of the weight components extend into the undercuts when the weight member is in both the unlocked and locked configurations to limit movement of the weight member in a direction normal to the weight mount. Preferably, at least a portion of each lateral undercut 32 is tapered so that sliding interaction between the inner ends 37, 39 of the weight components 26, 28 draw the weight member deeper into weight mount 24 toward base 29 of rail 25. That abutment and the larger dimension of the free end 27 of the rail prevents the weight member from moving in a direction normal to the weight mount 24 when it is in the locked configuration.

Figure 4:
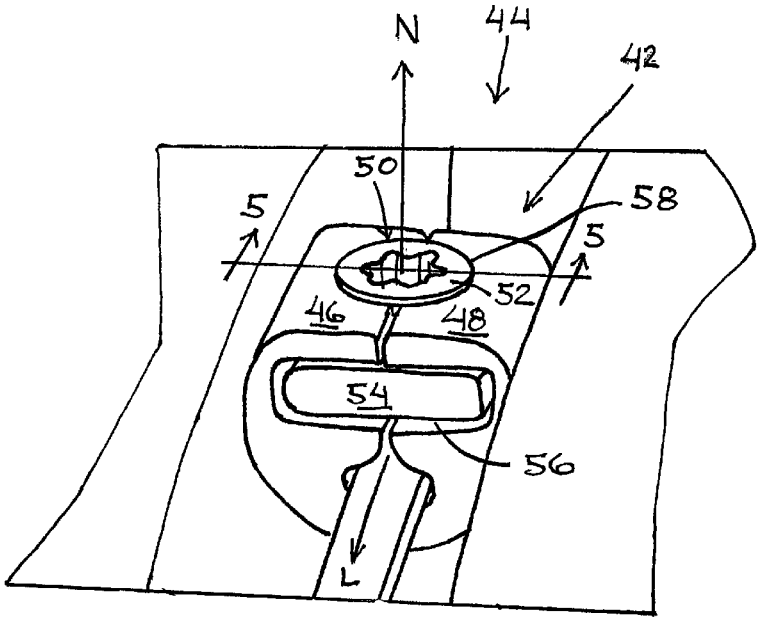
FIG. 4 is a perspective view of a portion of a golf club head of the present invention including a movable weight member.
Figure 5:
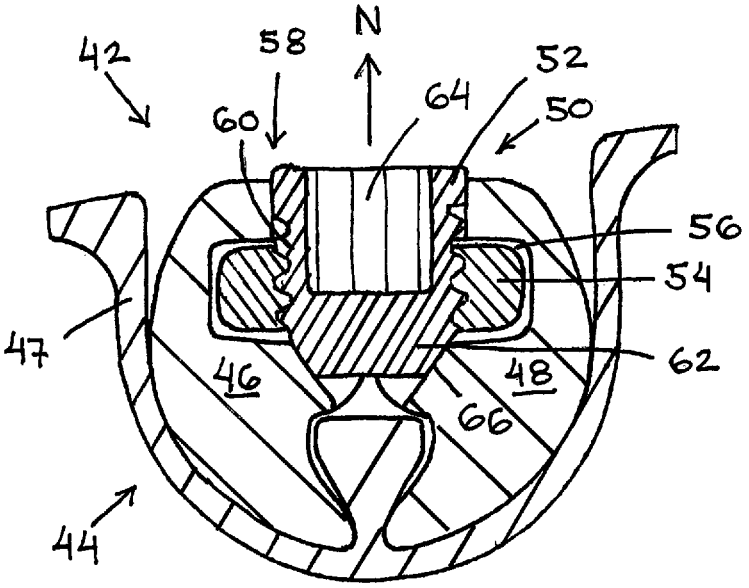
FIG. 5 is a cross-sectional view of a portion of the golf club head and movable weight member of FIG. 4, corresponding to line 5-5.

In another embodiment, shown in FIGS. 4 and 5, a weight member 42 includes a first weight component 46, a second weight component 48, and a two piece actuator 50. The weight member 42 has a similar construction and functions in the same way as weight member 22, but the two piece actuator is incorporated to simplify the construction of the first and second weight components 46, 48. A slot 56 is formed between the first weight component 46 and the second weight component 48. The first and second weight components 46, 48 also combine to define a bore 58 that extends generally parallel to the normal axis of the weight mount 44 and intersects the slot 56.

The actuator 50 includes a threaded fastener 52 and a threaded nut 54. The threaded fastener 52 includes a threaded portion 60, a tapered portion 62, and a tool engagement feature 64. The tool engagement feature 64 is disposed at a proximal, or outer, end where it is accessible to a user. The tapered portion 62 is disposed at the distal end of the fastener 52 which is on the opposite end of the fastener 52 from the tool engagement feature 64. The threaded portion 60 is interposed between the distal and proximal ends of the fastener 52. The threaded nut 54 preferably has a square or rectangular perimeter shape and a threaded bore. The threaded nut 54 is disposed in slot 56. The threaded fastener 52 extends through bore 58 and into slot 56 where it threads into the threaded bore of the threaded nut 54.

Each of the first and second weight components 46, 48 includes a tapered abutment surface 66. During use, the fastener 52 is threaded further into the threaded nut 54 to put the weight member 42 into the locked configuration. When the fastener is threaded further in, the tapered portion 62 of fastener 52 forcibly abuts the tapered abutment surface 66 of each of the first and second weight components 46, 48 and as the fastener is advanced it forces the weight components laterally outward toward the side wall 47 of the weight mount and deeper into the weight mount. The cylindrical side wall 47 of the weight mount 44 and the cylindrical outer surface of weight components 46, 48 provide sliding surfaces for the weight components 46, 48 to slide and rotate deeper into the weight mount 44 until inner ends 68, 70 of the first and second weight components 46, 48 abut and forcibly pinch a rail 45 disposed in the weight mount 44.

In the present embodiment, the rail 45 has a generally triangular cross-sectional shape having tapered side walls and is oriented so that it forms tapered lateral undercuts 72. The inner ends 68, 70 of the first and second weight components 46, 48 extend into lateral undercuts 72 and when the weight member 42 is in the locked configuration, the inner ends 68, 70 pinch the rail 45 in the lateral undercuts 72.

Figure 6:
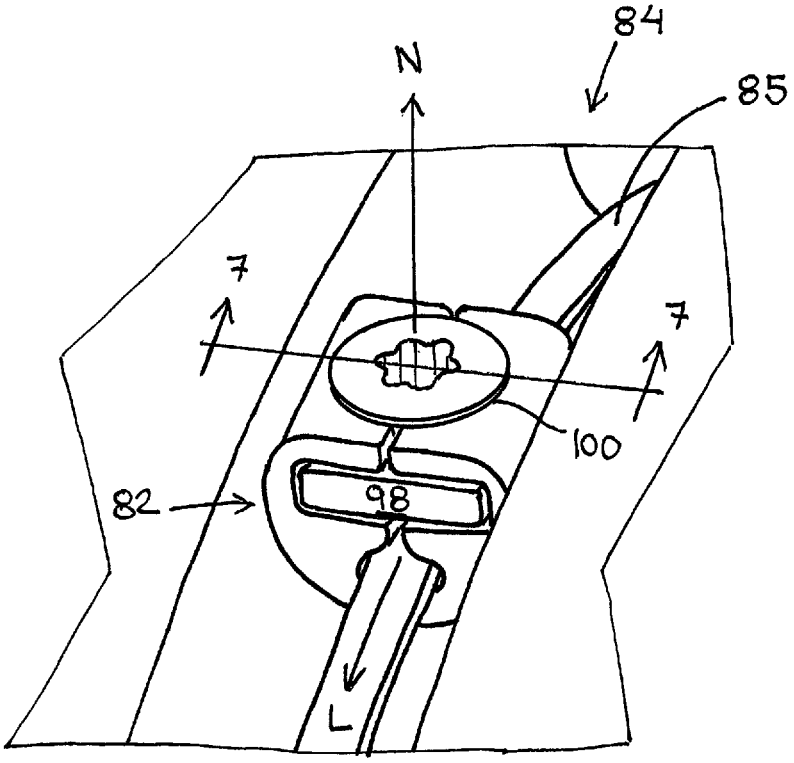
FIG. 6 is a perspective view of a portion of a golf club head of the present invention including a movable weight member.
Figure 7:
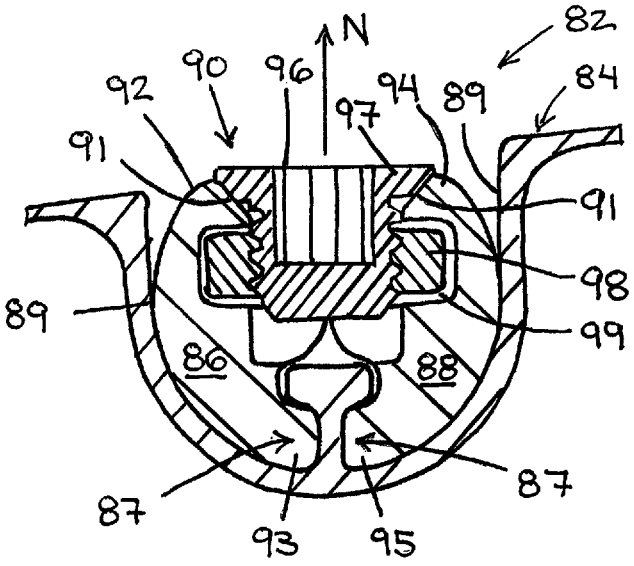
FIG. 7 is a cross-sectional view of a portion of the golf club head and movable weight member of FIG. 6, corresponding to line 7-7.

In another embodiment, shown in FIGS. 6 and 7, a weight member 82 having a similar construction as weight member 42 is shown. The weight member 82 is disposed in a weight mount 84 and includes a first weight component 86, a second weight component 88, and a two piece actuator 90. In the present embodiment, tapered abutment surfaces 91 of the first and second weight components 86, 88 are disposed at outer ends 92, 94 of the weight components. The two piece actuator 90 includes a threaded fastener 96 and a threaded nut 98. The threaded fastener 96 includes a tapered head portion 97 that abuts the tapered abutment surface 91 of the weight components. Similar to previous embodiments, the abutment between the fastener 96 and the tapered abutment surfaces 91 when the fastener 96 is advanced further into weight mount 84 causes the first and second weight components 86, 88 outward into sliding abutment with side walls 89 of weight mount 84 and deeper into the weight mount 84. When the weight member 82 is in the locked configuration, an inner end 93 of the first weight component 86 and an inner end 95 of the second weight component 95 pinch a rail 85 that forms a part of the weight mount.

Figure 8:
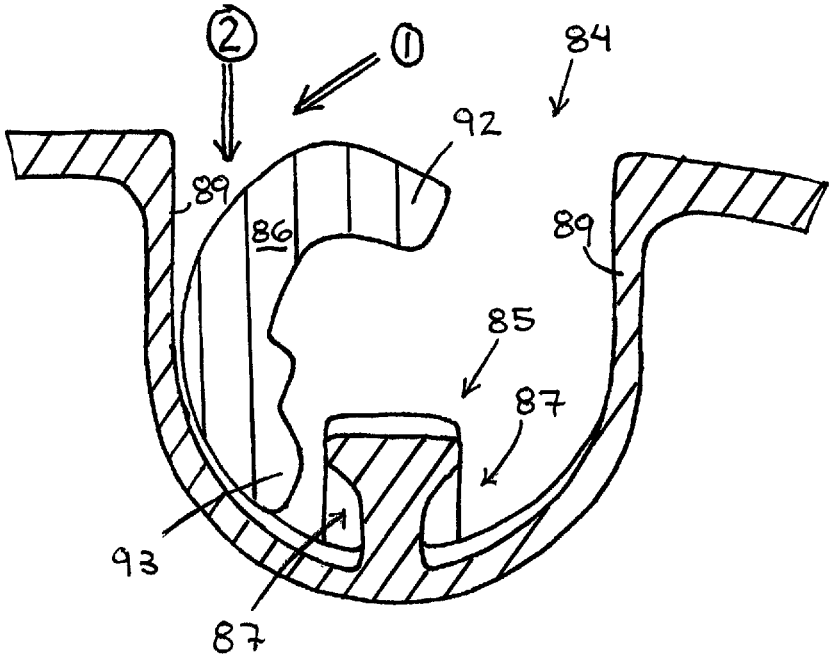
FIG. 8 is a cross-sectional view of a portion of the golf club head and movable weight shown in FIG. 6, illustrating a step in the assembly of the movable weight.
Figure 9:
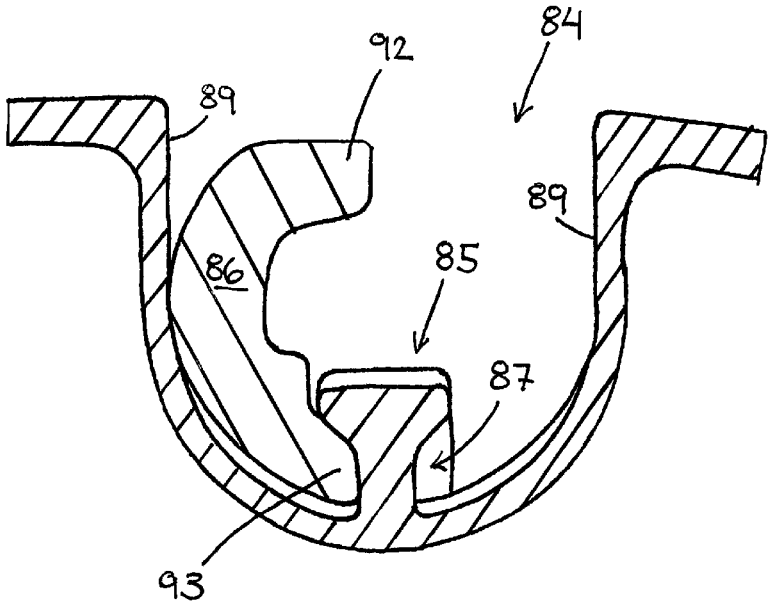
FIG. 9 is a cross-sectional view of a portion of the golf club head and movable weight shown in FIG. 6, illustrating a step in the assembly of the movable weight.
Figure 10:
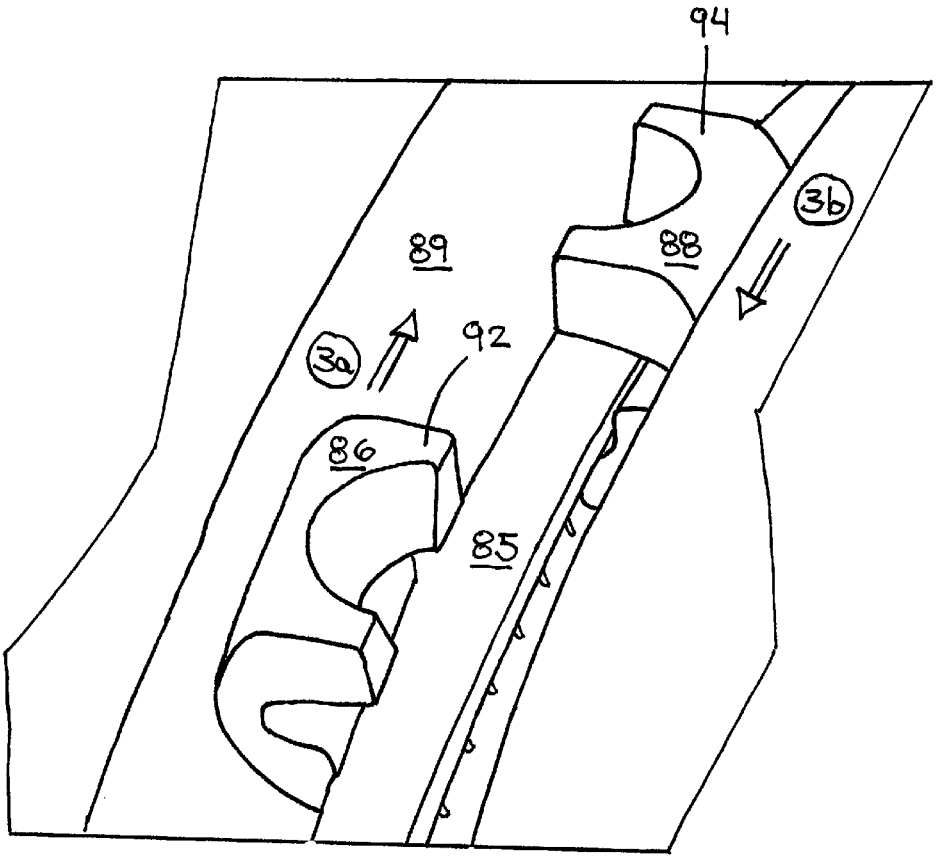
FIG. 10 is a perspective view of a portion of the golf club head and movable weight shown in FIG. 6, illustrating a step in the assembly of the movable weight.
Figure 11:
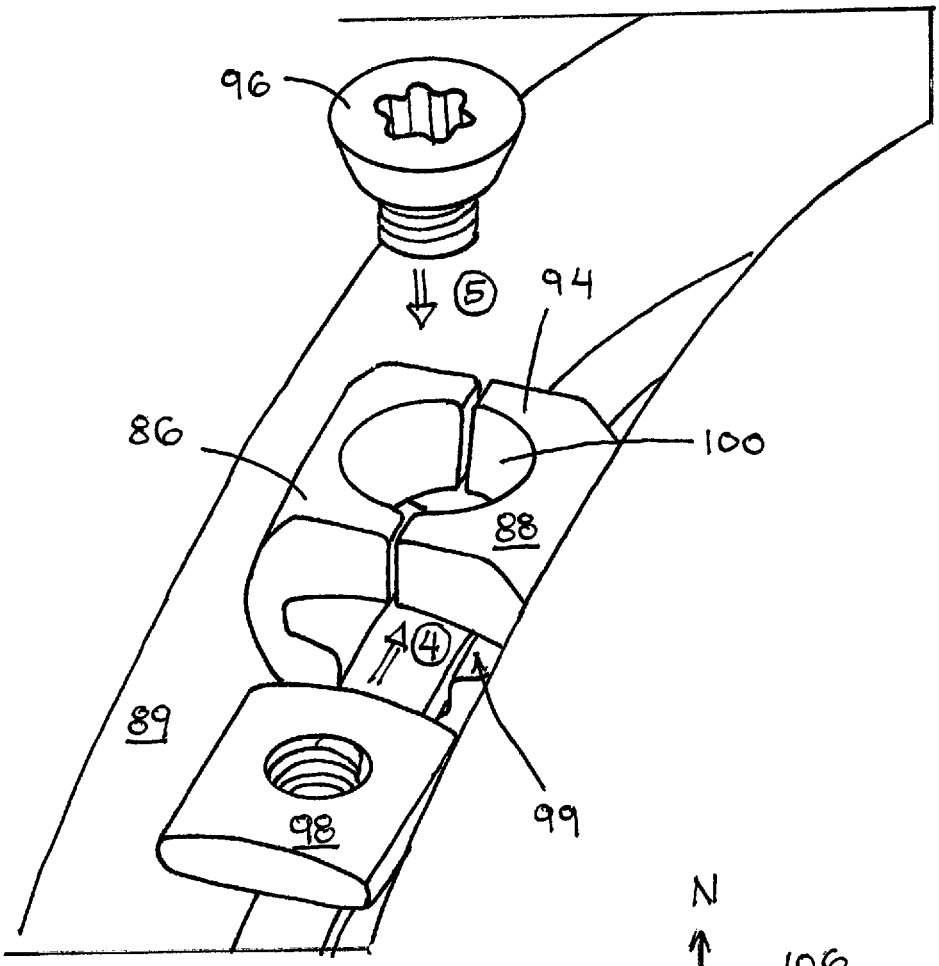
FIG. 11 is a perspective and partially exploded view of a portion of the golf club head and movable weight shown in FIG. 6, illustrating a step in the assembly of the movable weight.

Referring now to FIGS. 8-11, a method of assembling a weight member according to the present invention within a weight mount will be described. As noted, the construction of the weight members disclosed herein may be performed in the weight mount and do not require an opening or enlarged portion of the weight mount. As shown in FIGS. 8 and 9, each of the first and second weight components 86, 88 is inserted into the weight mount 84 independently. The first weight component 86 is inserted at an angle and then rotated leading with the inner end 93, shown by arrows 1 and 2 in FIG. 8, so that the inner end 93 is inserted into a lateral undercut 87 of the rail 85 and the weight component is generally in the same orientation as if the weight member 82 were fully assembled. Because of the angle required to insert each of the weight components, the second weight component 88 is inserted at a staggered location relative to the first weight component 86 using the same procedure. After the second weight component 88 is rotated into the same orientation as the final weight member assembly orientation, as shown in FIG. 10, the two weight components 86, 88 are aligned, as shown by arrows 3*a* and 3*b* in FIG. 10, so that they combine to form a slot 98 for threaded nut 98, and a bore 100 for threaded fastener 96, as shown in FIG. 11. Next, the threaded nut 98 is inserted into the slot 99 so that a threaded hole defined by the threaded nut is aligned with bore 100, as shown by arrow 4 in FIG. 11. Finally, the threaded fastener 96 is inserted into bore 100 and threaded into the threaded nut 98, as shown by arrow 5 in FIG. 11. Although the method of assembling the weight member is illustrated with weight member 82 of FIGS. 6 and 7, it should be appreciated that any of the weight members described herein may be assembled using the same method, unless specifically noted herein.

Figure 12:
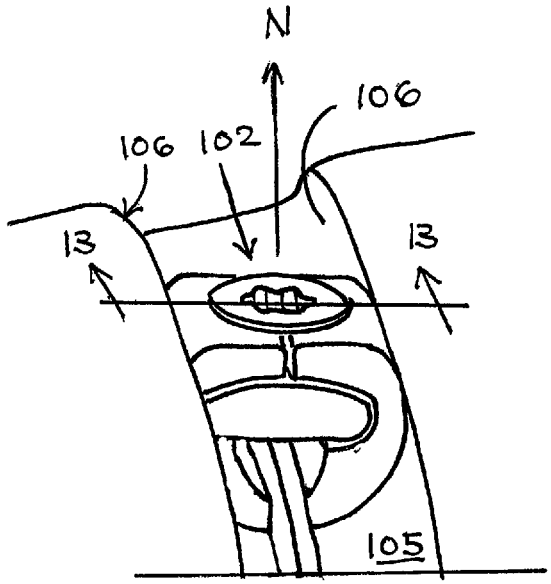
FIG. 12 is a perspective view of a portion of a golf club head of the present invention including a movable weight member.
Figure 13:
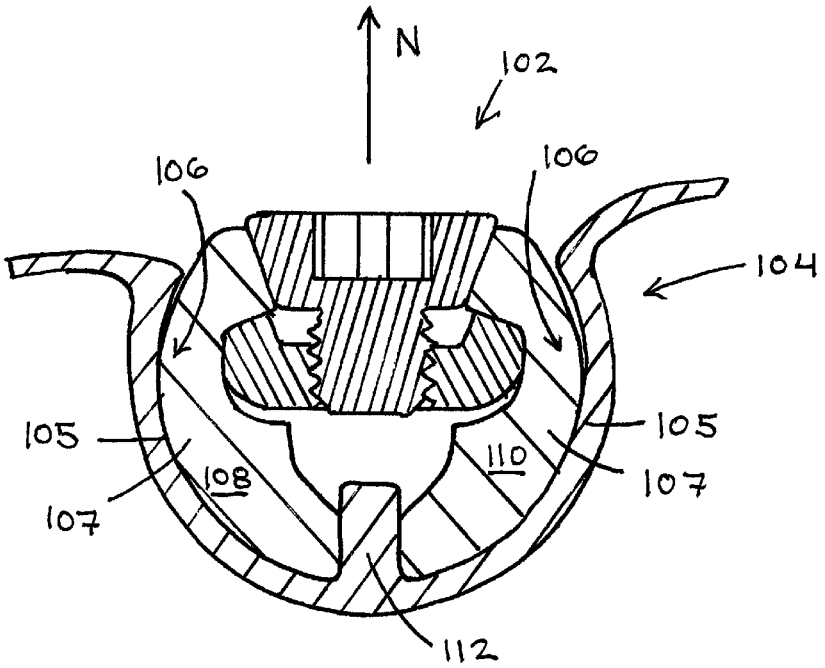
FIG. 13 is a cross-sectional view of a portion of the golf club head and movable weight member of FIG. 12, corresponding to line 13-13.

In another embodiment, shown in FIGS. 12 and 13, interaction between a weight member 102 and the side walls 105 of a weight mount 104 is used to limit the movement of the weight member 102 relative to the weight mount 104 in a direction normal to the weight mount, shown as axis N. In particular, the side walls 105 of the weight mount 104 form lateral undercuts 106 that receive middle portions 107 of each of a first weight component 108 and a second weight component 110. The lateral undercuts 106 of the side walls 105 of the weight mount 104 are result in an opening into the weight mount 104 having a width W1 that is smaller than a width of the assembled weight member W2 and smaller than a width W3 of the weight mount 104 at the location of the lateral undercuts 106. Including lateral undercuts 106 on the side walls 105 of the weight mount 104 obviates the need for including lateral undercuts on a rail 112 included in weight mount 104. Otherwise the operation, assembly and construction of weight member 102 are the same as described with regard to previous embodiments.

Figure 14:
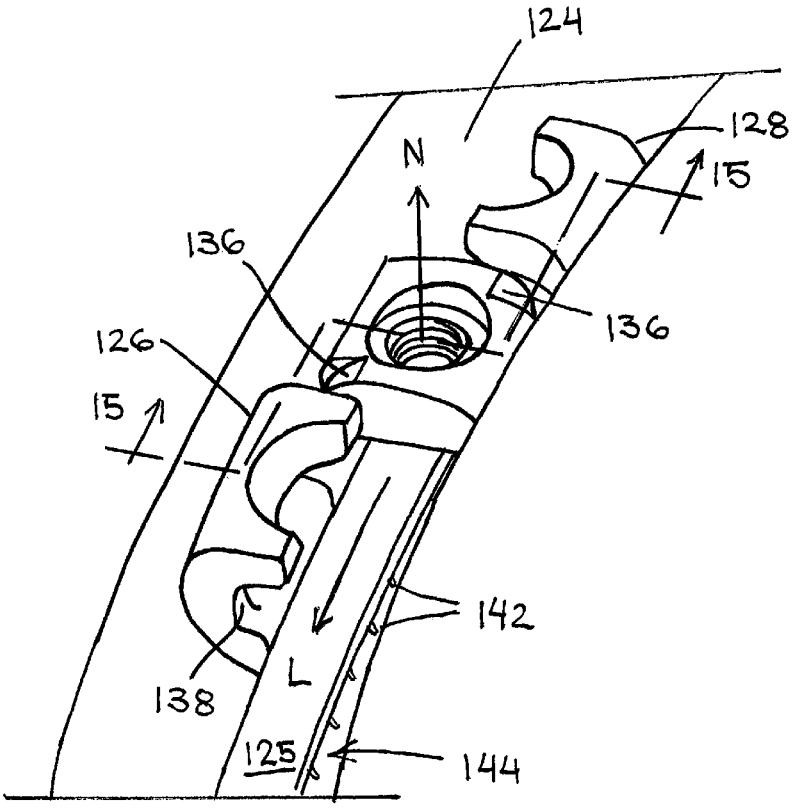
FIG. 14 is a perspective partially exploded view of a portion of a golf club head of the present invention including a movable weight member.
Figure 15:
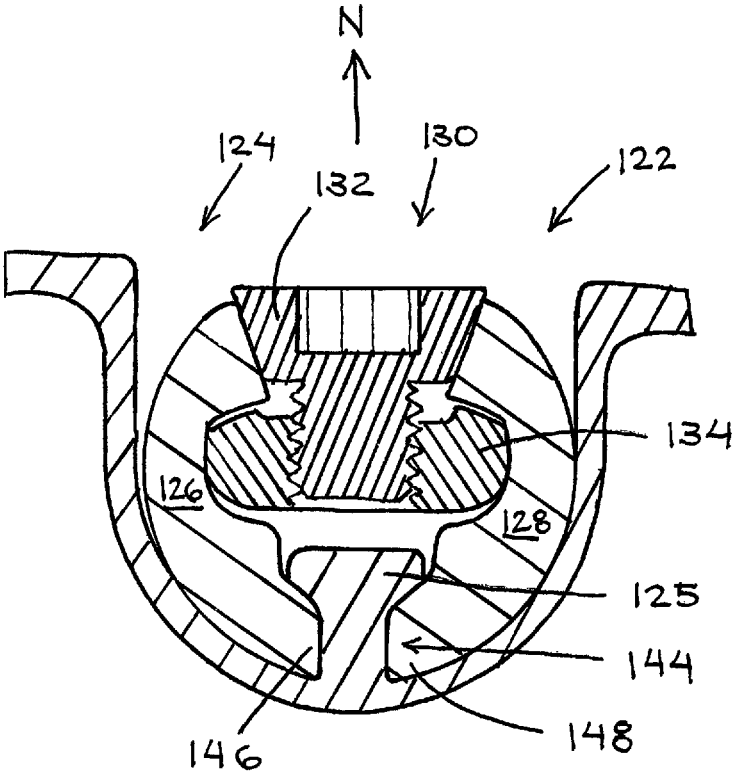
FIG. 15 is a cross-sectional view of a portion of the golf club head and movable weight member of FIG. 14, generally corresponding to line 15-15 and including a fastener.
Figure 16:
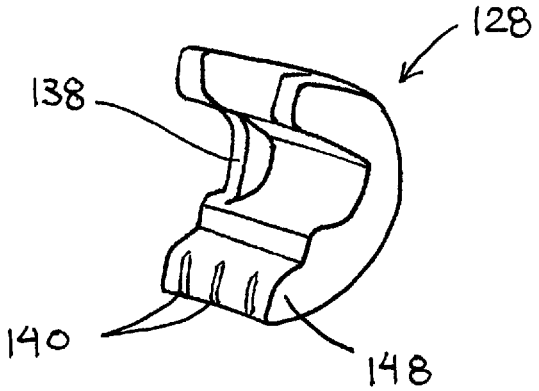
FIG. 16 is a perspective view of a weight component of the weight member of FIG. 14.

In another embodiment, shown in FIGS. 14-16, a weight member 122 is disposed in a weight mount 124 and includes a first weight component 126, a second weight component 128, and a two piece actuator 130. The two piece actuator 130 includes a threaded fastener 132 and a threaded nut 134 similar to previous embodiments. In the present embodiment, the threaded nut 134 and the first and second weight components 126, 128 include features that limit relative movement between the parts in preselected directions. In particular, the threaded nut 134 includes lateral notches 136 that complement and receive interior walls 138 on each of the first and second weight components 126, 128. As shown in FIG. 14, the interaction between the notches 136 and walls 138 dictates the directions that the components of the weight member 122 are moved relative to each other during the assembly of the weight member, and they alter the application of force between the components when the assembled weight member 122 is moved relative to weigh mount 124. Specifically, during assembly, the first and second weight components 126, 128 are moved relative to the threaded nut 134 in the direction shown by the arrows illustrated in FIG. 14, and the notches 136 and walls 138 limit the relative movement between the components.

The weight members and weight mounts of the present invention may also include complementary features that index the location of the weight member relative to the weight mount, and include a protrusion on a first component and a complementary recess on an opposing surface of a second component that moves relative to the first component. An example of indexing features is illustrated in FIGS. 14 and 16. Complementary indexing features provide tactile and/or audible feedback to a user when the weight member is moved along the weight mount, and may also provide increased resistance to relative movement between the weight mount and the weight member when the weight member is in a locked configuration. As shown, at least one of the first and second weight components includes a plurality of index notches 140 on an inner end that complement a plurality of index ribs 142 included in lateral undercuts 144 of a rail 125. When the weight member 122 is placed in a locked configuration in which the inner ends 146, 148 pinch rail 125, a plurality of index ribs 142 are disposed within the plurality of index notches 140. When the weight member 122 is in an unlocked configuration and is moved relative to the weight mount 124, the index notches 140 are intermittently engaged by a plurality of the index ribs 142 causing a clicking sensation thereby providing the user feedback. It should be appreciated that the notches and ribs may be located on the opposite structures so that the ribs are located on the weight component and the notches on the rail. As a further alternative, the indexing features may be disposed on the outer wall of a weight component and the side wall of the weight mount. Still further, it should be appreciated that any features on the weight member and the weight mount that provide such tactile and/or audible feedback to a user may be incorporated.

Figure 17:
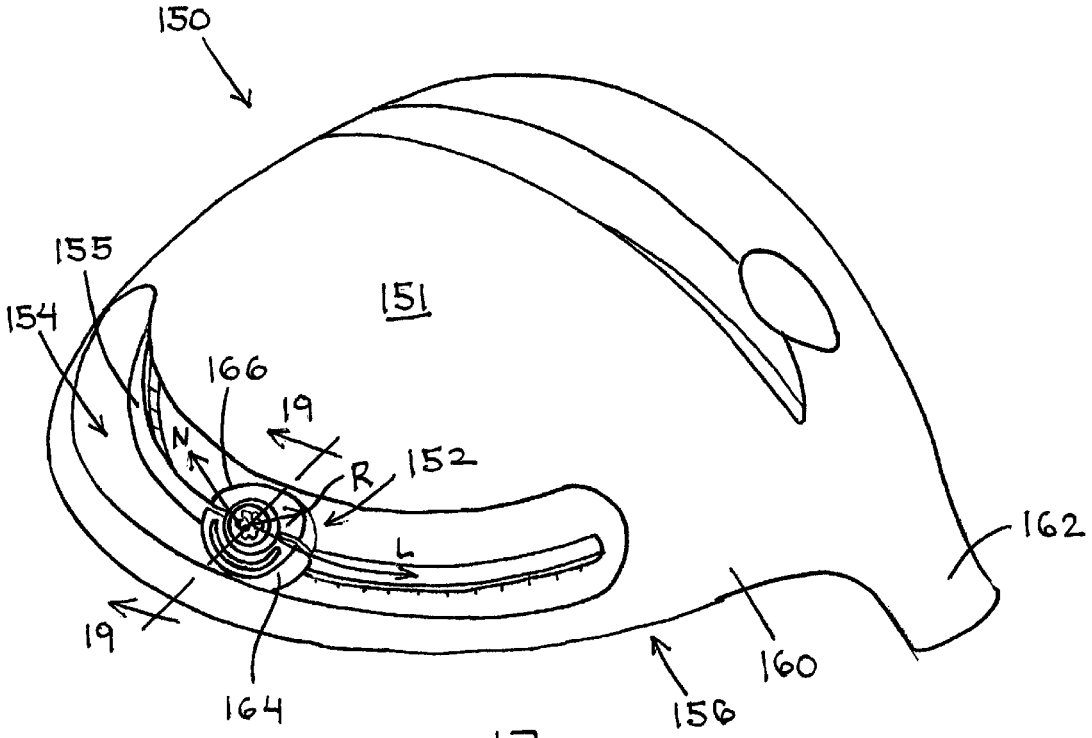
FIG. 17 is a perspective view of the sole of a golf club head including a movable weight.
Figure 18:
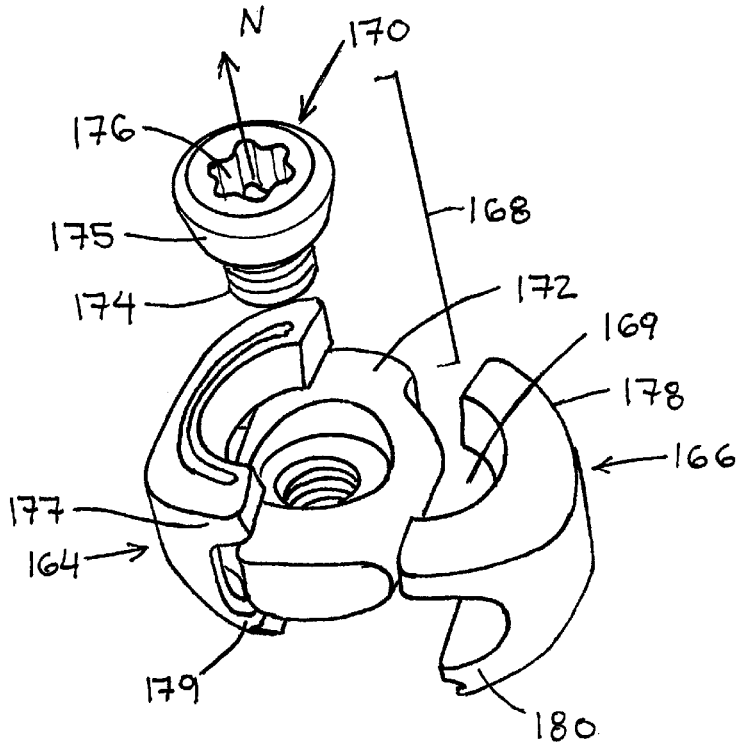
FIG. 18 is a perspective exploded view of the movable weight member of FIG. 17.
Figure 19:
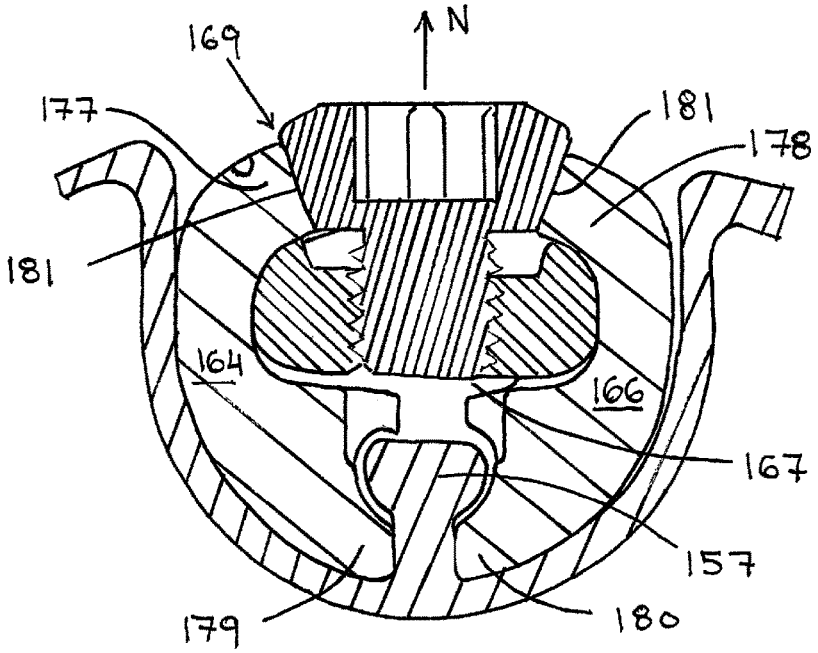
FIG. 19 is a cross-sectional view of a portion of the golf club head and movable weight member of FIG. 17, corresponding to line 19-19.

In another embodiment, shown in FIGS. 17-19, a golf club head 150 including a weight mount 154 having more complex curvature than previous embodiments is illustrated with a weight member 152 that is configured to traverse the more arcuate weight mount 154. Golf club head 150 generally has a hollow, metalwood-type construction and includes a sole 151, a crown 156, a hitting face 158, a skirt 160, a hosel 162, and the weight member 152. Sole 151 generally provides the lower surface of golf club head 150 when the club head is placed in an address position. Sole 151 includes a weight mount 154, which is configured to couple the weight member 152 to the sole 151. In the present embodiment, weight mount 154 is an elongate recessed portion of sole 151 that forms a channel, which may be generally linear when viewed from a bottom view of the golf club head, and the weight mount 154 defines an inner surface that is exposed to the exterior of the golf club head.

In the previously illustrated embodiments, the longitudinal axis of the weight mount was generally parallel to a plane that included a normal axis of the weight mount, so that when viewed from a bottom view of the golf club head the weight mount followed a linear path. In the present embodiment, the weight mount 154 is curved to generally match the curved shape of the perimeter of the golf club head 150 and weight member 152 is shaped so that it is able to slide along the entire curved length of the weight mount 154.

Weight mount 154 also includes a protruding rail 155 that is disposed inside the elongate recess and generally extends longitudinally through the channel. The rail 155 includes undercut side walls so that it has a cross-sectional shape that is generally wider at a free end 157 of the rail 155 than at a base 159 of the rail 155, and in particular has a cross-sectional shape that is generally "T"-shaped to form stepped lateral undercuts. As an alternative, the cross-sectional shape may be triangular and oriented so that it also forms tapered undercut side walls of the rail. As will be described in greater detail below, the undercut side walls of the rail 155 interact with the weight member 152 to restrict relative motion between the weight member and the weight mount in directions longitudinally along the weight mount and in a direction generally normal to the weight mount so that the weight member is retained within the weight mount, as shown generally by the normal ("N") and longitudinal ("L") axes.

The weight member 152 has a multi-piece construction including a first weight component 164, a second weight component 166, and a two-piece actuator 168. Each of the first weight component 164 and second weight component 166 includes an outer surface is shaped to complement the shape of the side walls 161 of the weight mount 154, in particular, the cross-sectional shape of the weight member 152 is circular to complement the circular cross-sectional shape of the weight mount 154. The first and second weight components 164, 166 combine to define a slot 167 that receives threaded nut 172 and a bore 169 that receives the threaded fastener 170.

The actuator 168 includes a threaded fastener 170 and a threaded nut 172. The threaded fastener 170 includes a threaded portion 174, a tapered portion 175, and a tool engagement feature 176. The threaded portion 174 is disposed at a distal end of the fastener 170. The tool engagement feature 176 is disposed at a proximal, or outer, end of the fastener 170 where it is accessible to a user. The tapered portion 175 is also disposed at the proximal end of the fastener 170. The threaded nut 172 preferably has a square or rectangular perimeter shape and a threaded bore. The threaded nut 172 is disposed in slot 167 and the threaded fastener 170 extends through bore 169 and into slot 167 where it threads into the threaded bore of the threaded nut 172. An outer surface 173 of threaded nut 172 is curved laterally to slidably abut a curved inner surface of slot 167 formed in first and second weight components 164, 166 during use.

During use, when the threaded fastener 170 is advanced toward rail 155, the tapered portion 175 abuts tapered abutment surface 181 of the weight components. The abutment between the fastener 170 and the tapered abutment surfaces 181 when the fastener 170 is advanced causes the first and second weight components 164, 166 outward and deeper into the weight mount. When the weight member 152 is in the locked configuration, an inner end 179 of the first weight component 164 and an inner end 180 of the second weight component 166 pinch the rail 155 that forms a part of the weight mount 154.

The actuator 168 is coupled to the first weight component 164 and the second weight component 166 so that it spreads outer ends 177, 178 of the weight components 164, 166 away from each other. When the outer ends are spread away from each other, the interaction between the outer surfaces of the weight components and the inner surfaces of the weight mount side walls forces the weight components 164, 166 to rotate and slide along the side wall of the weight mount 154. As a result, the inner ends 179, 180 of the weight components 164, 166 move toward each other and toward rail 155. As the inner ends of the weight components 164, 166 move toward each other, the rail 155 is pinched between them, thereby locking the weight member 152 in place longitudinally within weight mount 154.

Similar to the other embodiments, each of the pieces of weight member 152 is sized and shaped to allow the weight member 152 to be assembled within the weight mount 154. When weight member 152 is assembled in the weight mount, the weight member may be configured to be unlocked or locked. In the unlocked configuration, the assembled weight member is movable along the elongate weight mount along the longitudinal axis L, but is restricted from being removed from the weight mount. In the locked configuration, the weight member interacts with the rail of the weight mount to restrict longitudinal movement of the weight member relative to the weight mount. Interaction between the weight member and the undercuts of the rail restrict relative movement between the weight member and the weight mount in a direction normal to the weight mount.

The weight member 152 is also shaped so that it is easily movable through the complex curvature of the weight mount 154 when the weight member 152 is in the unlocked configuration. In particular, each of the first and second weight components 164, 166 includes a curved perimeter, such as by being formed with curved surfaces that are generally curved about an axis that is parallel to a longitudinal axis of the threaded fastener 170 (i.e., an axis that is generally parallel to a normal axis N relative to weight mount 154), as shown by radius of curvature R in FIG. 17.

In the previously described embodiments, the actuator has included threaded components such as a threaded fastener and a threaded nut. It should be appreciated that the threads in those embodiments may have any thread configuration and may be shaped to reduce the number of turns of the fastener for a predetermined longitudinal travel required to cause the outer ends of the weight components to move laterally away from each other to lock the weight member. Threads requiring fewer turns include helical threads, or fasteners including slots and projections that are often referred to in the art as quarter or half turn fasteners.

Figure 20:
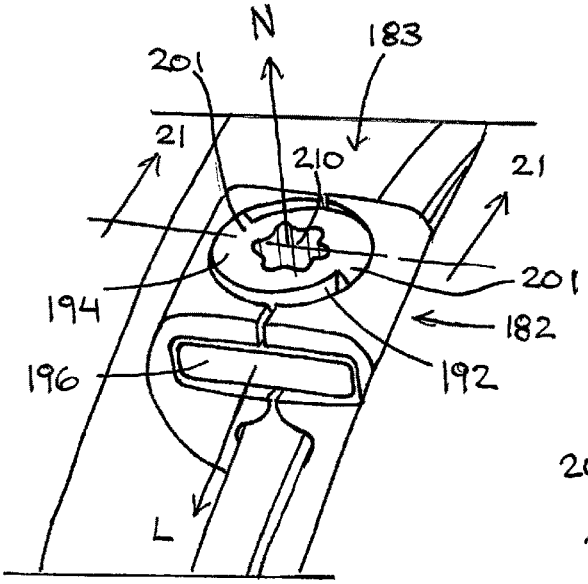
FIG. 20 is a perspective view of a portion of a golf club head of the present invention including a movable weight member.
Figure 21:
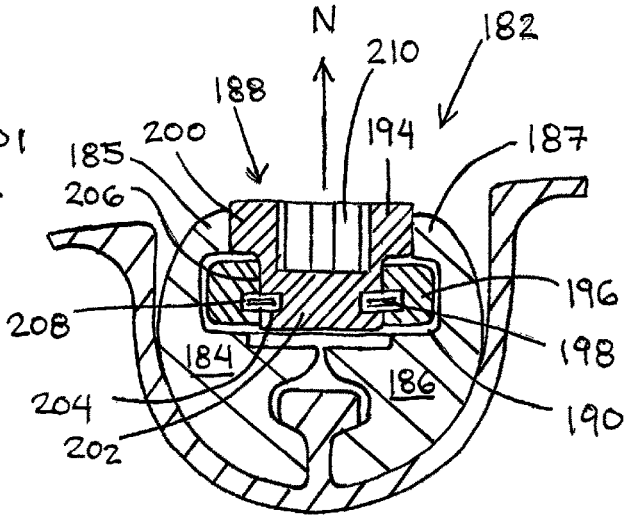
FIG. 21 is a cross-sectional view of a portion of the golf club head and movable weight member of FIG. 20, corresponding to line 21-21.

As a still further alternative, a non-threaded actuator may be utilized. An example of a non-threaded fastener is illustrated in FIGS. 20 and 21. In particular, a weight member 182 having a construction similar to weight member 42 of FIGS. 4 and 5, but including a non-threaded actuator will be described. Weight member 182 includes a first weight component 184, a second weight component 186, and a three piece cam actuator 188. The weight member may be locked in position within a weight mount 183, or unlocked and slid longitudinally through the weight mount 183. The first and second weight components 184, 186 combine to define a slot 190 and a bore 192. The bore 192 extends generally parallel to the normal axis of the weight mount 183 and intersects the slot 190.

The actuator 188 includes a cam fastener 194, a fastener plate 196, and a retaining ring 198. The cam fastener 194 includes a head 200, and a shank 202 extending from the head 200 into a bore 206 defined by the fastener plate 196. The shank 202 also includes a circumferential channel 204 that is disposed juxtaposed to a circumferential channel 208 included in the bore 206 of the fastener plate 196, and the retaining ring 198 is disposed in the channel defined by the circumferential channels of the shank 202 and fastener plate 196. The retainer ring 198 allows the cam fastener 194 to be rotatably coupled to the fastener plate 196.

The head 200 includes a non-circular side wall that includes cam portions 201, and a tool engagement feature 210 that is disposed at a proximal, or outer, end where it is accessible to a user. The cam portions extend laterally outward from a normal axis N further than the other portions of the head 200 so that when the cam fastener 194 is rotated in the bore 192, the outer ends 185, 187 are forced laterally outward away from each other the configure the weight member 182 in the locked configuration.

Figure 22:
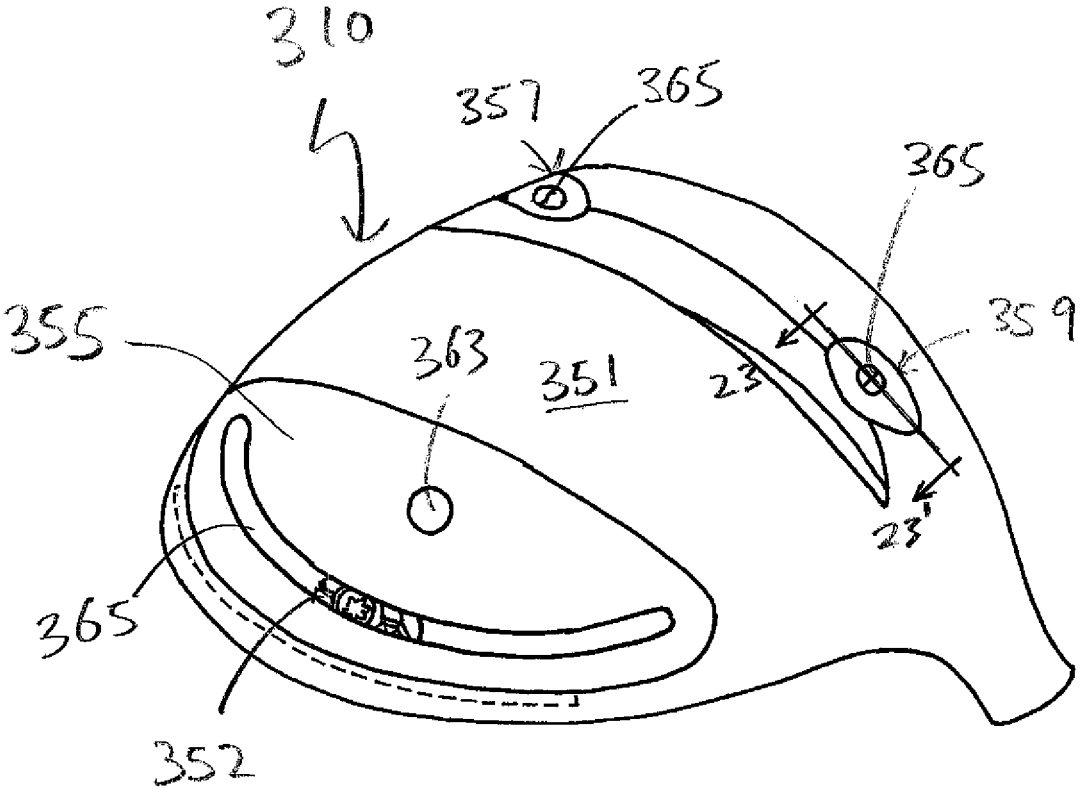
FIG. 22 is a perspective view of the sole of a golf club head including weight and port covers.
Figure 23:
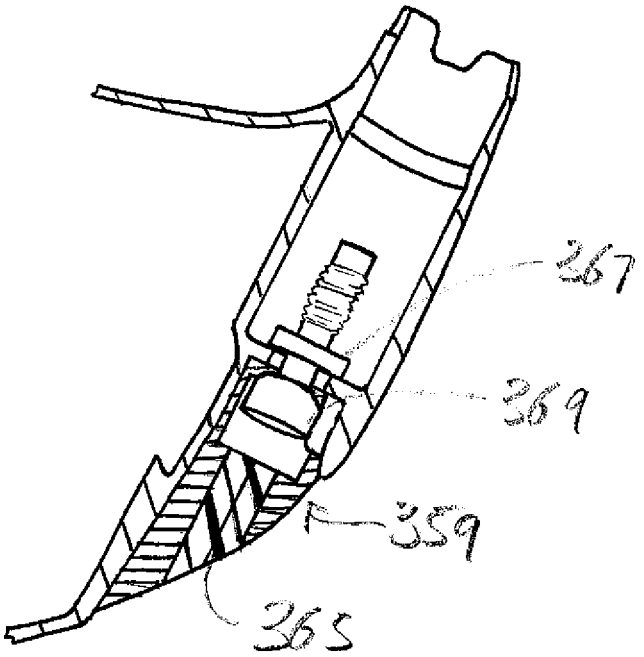
FIG. 23 is a cross-sectional view of a portion of the golf club head and port covers of FIG. 22, corresponding to line 23-23'.

FIGS. 22-23 of the accompanying drawings provide illustration of a golf club head 310 in accordance with an alternative embodiment of the present invention. More specifically, in this alternative embodiment of the present invention shown in FIG. 22, the weight member 352 located near the sole 351 of the golf club head 310 may be covered up by a polymeric weight cover 355 to provide an improvement in the aesthetics of the golf club head 310. More specifically, the polymeric weight cover 355 may be an oversized polymeric piece that is made out of a elastomer type compound similar to those types of compound used by consumer electronics when covering up charging ports. This type of weight cover 355, in addition to improving the aesthetics of the golf club head 310 by covering up unsightly weighting components such as the weight member 352, may also provide protection of the weighting elements from potential damage with the ground. Alternatively speaking, it can be said that the weight cover 355 substantially conceals the weight member 352 from sight when installed. The weight covers 355 may generally be retained to the golf club head 310 via a removable attachment mechanism 363. The attachment mechanism 363 shown in this embodiment of the present invention may generally be a threaded attachment mechanism 363, however, alternative types of attachment mechanisms 363 may be used without departing from the scope and content of the present invention so long as it is capable of retaining the pieces together.

Finally, in order to provide access to threaded components associated with the weight member 352 underneath the weight cover 355, the present invention incorporates a slit 365 onto the weight cover 355 to achieve this goal. The slit 365 shown here in FIG. 22 associated with this embodiment of the present invention may generally allow visibility of the actual head of the screw itself, however in alternative embodiments of the present invention the slit 365 could completely cover the opening and deforms non-plastically only when needed. Alternatively, it can be said that the slit non-plastically deforms when it bends away to provide access to the weight member and returns to its original position when access to the weight member is not needed.

In addition to illustrating the weight cover 355, FIG. 22 of the accompanying drawings also shows that the present inventive golf club head 310 may also have at least one port cover to help cover and protect additional ports or openings in the sole of the golf club head 310. More specifically, FIG. 22 of the accompanying drawings shows a toe side port cover 357 as well as a heel side port cover 359. These port covers 357 and 359 may generally be made out of the same polymeric material previously discussed when describing the weight cover 355. The port covers 357 and 359 may generally be fixedly attached to the golf club head 310 itself, as there is generally no need to remove these types of covers to access the internal components. However, alternative methods of attachment may also be used to attach the port covers 357 and 359 without departing from the scope and content of the present invention.

Finally, in order to provide access to threaded components often concealed underneath the port covers 357 and 359, these port covers 357 and 359 incorporate non-visible slits 365 that deforms when a tool and or device engages the threaded component, but readily returns to its original shape once the tool and or device is removed. In order to further illustrate this slit feature, a cross sectional view of the heel side port cover 359 is provided in FIG. 23, taken across cross-sectional line 23-23'.

FIG. 23 of the accompanying drawings shows a cross-sectional view of a hosel portion of a golf club head 310 associated with an embodiment of the present invention. More specifically, the cross-sectional view of the hosel portion of the golf club head 310 shows how the port cover 359 may be used to cover up an opening in the sole portion of the golf club head 310, all while providing access to the threaded attachment mechanism 369 via the slit 365. In this embodiment, the threaded attachment mechanism 369 is held in place by a washer 367 to prevent it from falling out into the port cover 359.

Figure 24:
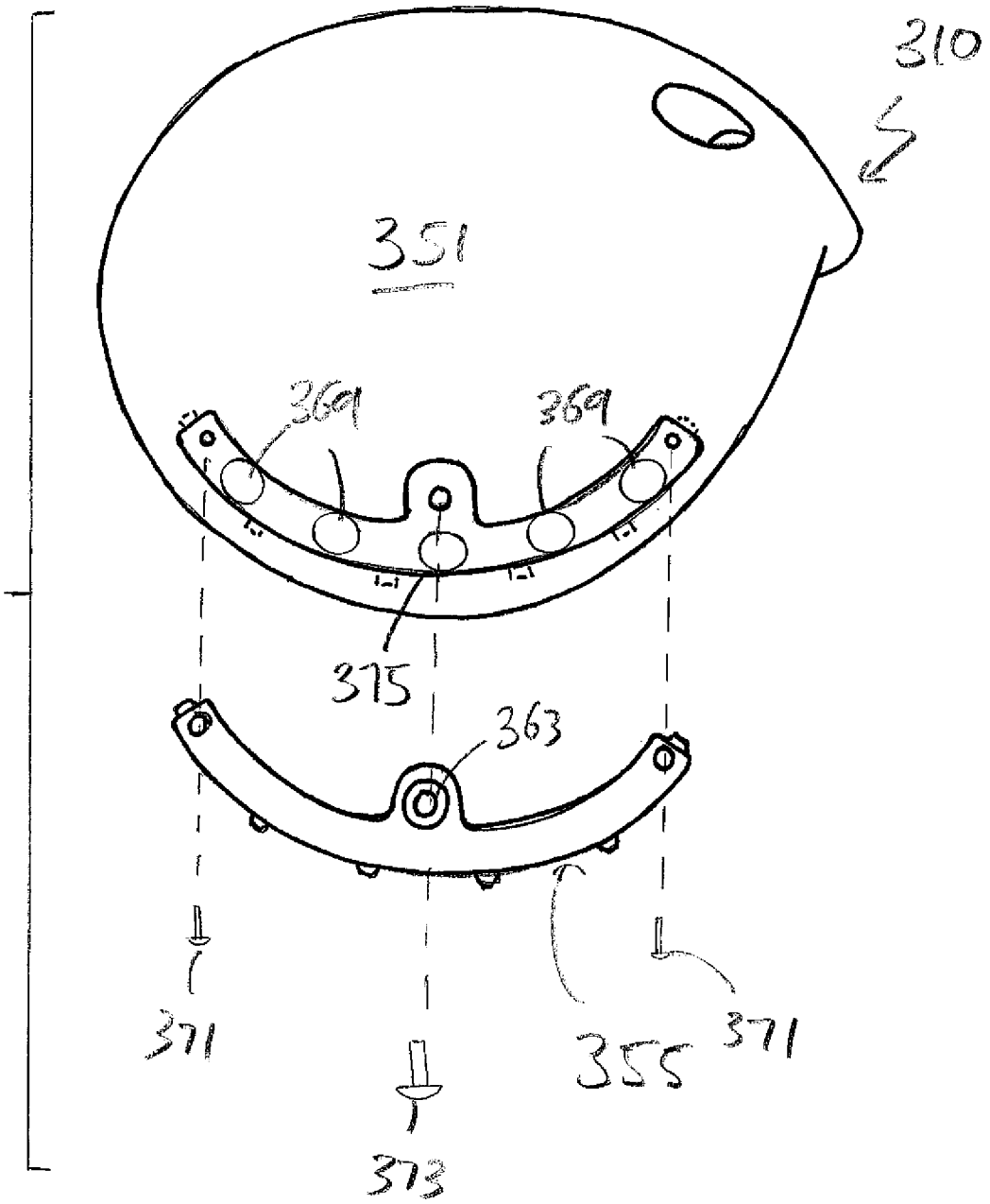
FIG. 24 is an exploded perspective sole view of a golf club head in accordance with an alternative embodiment of the present invention.

FIG. 24 of the accompanying drawings shows an exploded sole view of a golf club head 351 in accordance with an even further alternative embodiment of the present invention. In this alternative embodiment of the present invention, the golf club head 351 incorporates a weight cover 355 that has the capabilities of adjusting the CG properties of the golf club head on its own, instead of being a cover an existing weighting member as shown in FIG. 22. In this embodiment of the present invention, the weight cover 355 may incorporate a plurality of dual purpose screws that can not only help retain any components underneath the weight cover 355, but can actually be weighting members themselves by making them out of different materials having different densities. In the exemplary embodiment shown in FIG. 24, the golf club head 351 incorporates four lightweight dual purpose screws 369 around the heel and toe portion of the golf club head 351, and one heavyweight dual purpose screw 375 located centrally near the rear portion of the golf club head 351. This type of construction allows for a low and rearward CG location, but alternative arrangements of interchanging the location of the lightweight dual purpose screws 369 and the heavyweight dual purpose screw 375 may be used without departing from the scope and content of the present invention. In fact, in an even further alternative embodiment of the present invention, the number of lightweight dual purpose screws 369 and heavyweight dual purpose screws 375 may be altered to achieve the weighting goals of the present invention without departing from the scope and content of the present invention.

FIG. 24 of the accompanying drawings also that in this alternative embodiment of the present invention, the weight cover 355 may be secured by a three piece attachment mechanism 363. This exploded view shows that in one embodiment of the present invention, the attachment mechanism 363 may utilize threaded screws. In fact, the size of the screws may be different enough so that a large screw 373 is used near the middle of the weight cover 355, while small screws 371 may be used near the perimeter of the weight cover 371.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used independently or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

The invention claimed is:

1. A golf club head, comprising:

a hosel;

a ball striking face;

a sole extending aftward from a lower edge of the face;

a crown extending aftward from an upper edge of the face;

a skirt extending between the sole and the crown;

a weight mount disposed on at least one of the sole, the crown and the skirt, the weight mount including parallel side walls and an elongate rail, wherein the side walls extend from an outer surface of the golf club head and toward an interior of the golf club head and form a recessed channel, wherein the rail protrudes into the interior of the recessed channel, defines lateral undercuts, and extends longitudinally through the recessed channel;

a weight member that includes a first weight component, a second weight component, and an actuator; and a weight cover, substantially covering said weight member, wherein each of the first and second weight components defines an outer end and an inner end, and the first and second weight components combine to define a slot and a bore that intersects the slot, wherein the bore extends through the outer ends of the first and second weight components, wherein the inner ends of the first and second weight components are disposed in the lateral undercuts of the rail, wherein the actuator includes a threaded fastener and a threaded nut, wherein the threaded nut is disposed in the slot, and the threaded fastener is disposed in the bore and is threaded into a threaded bore included in the threaded nut;

the threaded fastener includes a tapered surface that abuts a tapered surface on each of the first and second weight components, wherein the tapered surfaces are angled so that the surfaces are tapered toward the center of the weight member as the tapered surfaces extend deeper into the weight mount so that the first and second weight components are forced laterally outward as the threaded fastener is advanced into the threaded nut, wherein a portion of the side walls of the weight mount is cylindrical and a portion of the outer surface of the weight member is cylindrical, wherein the weight member has an unlocked configuration and a locked configuration, wherein in the unlocked configuration the threaded fastener is in a first position and in the locked configuration the threaded fastener is in a second position threaded further into the threaded nut than in the first position and the tapered surface of the threaded fastener forcibly abuts the tapered surfaces of the first and second weight components so that the inner ends of the first and second weight components forcibly pinch the rail, and wherein the weight cover is formed of a polymeric material.

2. The golf club head of claim 1, wherein the polymeric material is elastomer.

3. The golf club head of claim 2, wherein the weight cover substantially conceals the weight member.

4. The golf club head of claim 3, wherein the weight cover further comprises a slit, the slit provides access to the weight member through the weight cover.

5. The golf club head of claim 4, wherein the slit non-plastically deforms when it bends away to provide access to the weight member.

6. The golf club head of claim 1, wherein the golf club head further comprises at least one port cover, the port cover substantially conceals an opening on the sole.

7. The golf club head of claim 6, wherein the opening on the sole is placed underneath the hosel.

8. The golf club head of claim 7, wherein the at least one port cover further comprises a slit, the slit provides access to a threaded mechanism underneath the hosel.

9. The golf club head of claim 8, wherein the slit non-plastically deforms when it bends away to provide access to the weight member.

10. The golf club head of claim 9, the port cover is formed of a polymeric material.

11. The golf club head of claim 10, wherein the polymeric material is elastomer.

12. The golf club head of claim 10, wherein the polymeric material is elastomer.

13. A golf club head, comprising:

a hosel;

a ball striking face;

a sole extending aftward from a lower edge of the face;

a crown extending aftward from an upper edge of the face;

a skirt extending between the sole and the crown;

a weight mount disposed on at least one of the sole, the crown and the skirt, the weight mount including parallel side walls and an elongate rail, wherein the side walls extend from an outer surface of the golf club head and toward an interior of the golf club head and form a recessed channel, wherein the rail protrudes into the interior of the recessed channel, defines lateral undercuts, and extends longitudinally through the recessed channel;

a weight member that includes a first weight component, a second weight component, and an actuator; and a port cover, substantially covering an opening in the sole, wherein each of the first and second weight components defines an outer end and an inner end, and the first and second weight components combine to define a slot and a bore that intersects the slot, wherein the bore extends through the outer ends of the first and second weight components, wherein the inner ends of the first and second weight components are disposed in the lateral undercuts of the rail, wherein the actuator includes a threaded fastener and a threaded nut, wherein the threaded nut is disposed in the slot, and the threaded fastener is disposed in the bore and is threaded into a threaded bore included in the threaded nut;

the threaded fastener includes a tapered surface that abuts a tapered surface on each of the first and second weight components, wherein the tapered surfaces are angled so that the surfaces are tapered toward the center of the weight member as the tapered surfaces extend deeper into the weight mount so that the first and second weight components are forced laterally outward as the threaded fastener is advanced into the threaded nut, wherein a portion of the side walls of the weight mount is cylindrical and a portion of the outer surface of the weight member is cylindrical, wherein the weight member has an unlocked configuration and a locked configuration, wherein in the unlocked configuration the threaded fastener is in a first position and in the locked configuration the threaded fastener is in a second position threaded further into the threaded nut than in the first position and the tapered surface of the threaded fastener forcibly abuts the tapered surfaces of the first and second weight components so that the inner ends of the first and second weight components forcibly pinch the rail, and wherein the port cover is formed of a polymeric material.

14. The golf club head of claim 13, wherein the opening on the sole is placed underneath the hosel.

15. The golf club head of claim 14, wherein the at least one port cover further comprises a slit, the slit provides access to a threaded mechanism underneath the hosel.

16. The golf club head of claim 15, wherein the slit non-plastically deforms when it bends away to provide access to the weight member.

17. The golf club head of claim 13, wherein the port cover is formed of a polymeric material.

* * * * *